US010083658B2

(12) United States Patent
Wang et al.

(10) Patent No.: US 10,083,658 B2
(45) Date of Patent: Sep. 25, 2018

(54) PIXEL CIRCUITS WITH A COMPENSATION MODULE AND DRIVE METHODS THEREOF, AND RELATED DEVICES

(71) Applicants: BOE TECHNOLOGY GROUP CO., LTD., Beijing (CN); ORDOS YUANSHENG OPTOELECTRONICS CO., LTD., Ordos (CN)

(72) Inventors: Bo Wang, Beijing (CN); Minghua Xuan, Beijing (CN); Zhanjie Ma, Beijing (CN)

(73) Assignees: BOE TECHNOLOGY GROUP CO., LTD., Beijing (CN); ORDOS YUANSHENG OPTOELECTRONICS CO., LTD., Ordos (CN)

( * ) Notice: Subject to any disclaimer, the term of this patent is extended or adjusted under 35 U.S.C. 154(b) by 11 days.

(21) Appl. No.: 15/307,997

(22) PCT Filed: Feb. 26, 2016

(86) PCT No.: PCT/CN2016/074675
§ 371 (c)(1),
(2) Date: Oct. 31, 2016

(87) PCT Pub. No.: WO2017/041453
PCT Pub. Date: Mar. 16, 2017

(65) Prior Publication Data

US 2017/0270860 A1 Sep. 21, 2017

(30) Foreign Application Priority Data

Sep. 10, 2015 (CN) ..... 2015 1 0575125

(51) Int. Cl.
*G09G 3/30* (2006.01)
*G09G 3/3258* (2016.01)

(52) U.S. Cl.
CPC ... *G09G 3/3258* (2013.01); *G09G 2300/0842* (2013.01); *G09G 2310/0251* (2013.01); *G09G 2320/0233* (2013.01)

(58) Field of Classification Search
CPC ..... G09G 3/30–3/3291
See application file for complete search history.

(56) References Cited

U.S. PATENT DOCUMENTS

2003/0103022 A1 6/2003 Noguchi et al.
2010/0013816 A1 1/2010 Kwak
(Continued)

FOREIGN PATENT DOCUMENTS

CN 1417767 5/2003
CN 101483068 7/2009
(Continued)

OTHER PUBLICATIONS

Notification of Reexamination from corresponding Chinese Application No. 201510575125.1, dated Aug. 9, 2017 (8 pages).
(Continued)

*Primary Examiner* — Sanghyuk Park
(74) *Attorney, Agent, or Firm* — Harness, Dickey & Pierce, P.L.C.

(57) ABSTRACT

The present disclosure discloses a pixel circuit, a drive method thereof, and a related device, comprising: a first reset module, a data write module, a compensation module, a voltage stabilization module, a drive control module, a light emission control module and a light emission component. The pixel circuit can compensate for the drift of the threshold voltage of the drive control module by the cooperation of the above-described modules.

16 Claims, 10 Drawing Sheets

(56) References Cited

U.S. PATENT DOCUMENTS

| | | | | |
|---|---|---|---|---|
| 2011/0193856 | A1 | 8/2011 | Han | |
| 2014/0111563 | A1* | 4/2014 | Hwang | H04N 13/0438 345/691 |
| 2014/0168180 | A1 | 6/2014 | Kim | |
| 2016/0148573 | A1* | 5/2016 | Lai | G09G 3/3233 345/205 |
| 2016/0155387 | A1* | 6/2016 | Kim | G09G 3/3291 345/76 |
| 2016/0372049 | A1 | 12/2016 | Wang et al. | |

FOREIGN PATENT DOCUMENTS

| | | | |
|---|---|---|---|
| CN | 101630481 | | 1/2010 |
| CN | 103280182 | | 9/2013 |
| CN | 103839513 | A | 6/2014 |
| CN | 203882588 | U | 10/2014 |
| CN | 104157240 | | 11/2014 |
| CN | 104157240 | A | 11/2014 |
| CN | 104575389 | A | 4/2015 |
| CN | 104575419 | | 4/2015 |
| CN | 105185305 | A | 12/2015 |
| KR | 20100045578 | A | 5/2010 |

OTHER PUBLICATIONS

Written Opinion of the International Searching Authority from corresponding PCT Application No. PCT/CN2016/074675 (5 pages), dated Jun. 13, 2016.

Office Action from corresponding Chinese Application No. 201510575125.1 (8 pages), dated Oct. 25, 2016.

International Search Report from corresponding PCT Application No. PCT/CN2016/074675 (5 pages), dated Jun. 13, 2016.

* cited by examiner

PIXEL CIRCUITS WITH A COMPENSATION MODULE AND DRIVE METHODS THEREOF, AND RELATED DEVICES

This application claims the benefit and priority of Chinese Patent Application No. 201510575125.1, filed on Sep. 10, 2015, the entire disclosure of which is incorporated by reference herein.

FIELD

The present disclosure relates to the field of organic electroluminescent technology, and particularly, to a pixel circuit and a drive method thereof, and a related device.

BACKGROUND

Organic Light Emitting Diode (OLED) is one of the focuses in the field of flat panel display research. Compared with the liquid crystal display, OLED has the advantages of low power consumption, low production cost, self-light emission, wide viewing angle and fast response. At present, in mobile phones, PDAs, digital cameras and other display fields, OLED has begun to replace the traditional LCD display. Among them, the pixel circuit design is the core technology of OLED display, and has important research significance.

Unlike LCDs that use a stable voltage to control illuminance, OLEDs are current driven and require a constant current to control light emission. Due to manufacturing process and device aging and other reasons, the threshold voltage $V_{th}$ of the drive transistor of the pixel circuit has unevenness, which causes the current flowing through the OLED in each pixel point to change thereby resulting in uneven display illuminance and thus affecting the display effect of the entire image.

FIG. 1 is a schematic circuit diagram of a pixel circuit in the prior art. As shown in FIG. 1, taking an existing pixel circuit with two transistors and one capacitor (2M1C) as an example, the circuit comprises one drive transistor M2, one switch transistor M1, and one storage capacitor Cs. When a pixel circuit of a certain row is scanned, a low level signal is inputted to the scan line Scan of the pixel circuit of this row, the P-type switch transistor M1 is turned on and the voltage of the data line Data is written into the storage capacitor Cs. When the scanning of this row is completed, the signal inputted into the scan line Scan becomes high level, the P-type switch transistor M1 is turned off, and the gate electrode voltage stored by the storage capacitor Cs causes the drive transistor M2 to generate current to drive the OLED and ensure that the OLED continuously emits light within one frame. The saturation current formula for the drive transistor M2 is $I_{OLED}=K(V_{SG}-V_{th})^2$. As described above, due to manufacturing process, device aging and other reasons, the threshold voltage $V_{th}$ of the drive transistor M2 will drift, and furthermore, due to IR Drop, the source voltage $V_S$ of the drive transistor M2 may also vary. This causes the current flowing through each OLED to vary as the threshold voltage $V_{th}$ of the drive transistor and the voltage VDD applied at the source of the drive transistor vary, resulting in unevenness in illuminance of image.

SUMMARY

Embodiments of the present disclosure provide a pixel circuit, a drive method thereof and a related device.

According to a first aspect, embodiments of the present disclosure provide a pixel circuit comprising: a first reset module, a data write module, a compensation module, a voltage stabilization module, a drive control module, a light emission control module and a light emission component. The first reset module is connected to the voltage stabilization module and the first reset module is configured to reset the voltage stabilization module. The data write module is connected to the voltage stabilization module and the data write module is configured to provide a data signal to the voltage stabilization module. The compensation module is connected to the voltage stabilization module and the drive control module, and the compensation module is configured to store the threshold voltage of the drive control module in the voltage stabilization module. The voltage stabilization module is connected to the drive control module, and the voltage stabilization module is configured to store a voltage for controlling the drive control module. The drive control module is connected to the light emission control module, and the drive control module is configured to drive the light emission component. The light emission control module is connected to the drive control module and the light emission component, and the light emission control module is configured to control the drive of the drive control module for the light emission component. The light emission component is connected to the light emission control module, and the light emission component is configured to emit light under the drive of the drive control module.

In embodiments of the present disclosure, the first reset module comprises a control terminal, a first input terminal, a second input terminal, a first output terminal, and a second output terminal. The data write module comprises a control terminal, an input terminal and an output terminal. The compensation module comprises a control terminal, an input terminal and an output terminal. The voltage stabilization module comprises a first terminal and a second terminal. The drive control module comprises a control terminal, an input terminal and an output terminal. The light emission control module comprises a control terminal, a first input terminal, a second input terminal, a first output terminal and a second output terminal. The light emission component comprises a first terminal and a second terminal. The control terminal of the first reset module is connected to a first reset control signal terminal, the first input terminal of the first reset module is connected to the input terminal of the drive control module and a first reference signal terminal respectively, the second input terminal of the first reset module is connected to an initialization signal terminal, the first output terminal of the first reset module is connected to the first terminal of the voltage stabilization module, the output terminal of the data write module and the first output terminal of the light emission control module respectively, and the second output terminal of the first reset module is connected to the second terminal of the voltage stabilization module, the control terminal of the drive control module and the output terminal of the compensation module. The first reset module is configured to reset the electric levels of the first terminal and the second terminal of the voltage stabilization module under the control of a signal of the first reset control signal terminal. The control terminal of the data write module is connected to a write control signal terminal and the input terminal of the data write module is connected to the data signal terminal. The data write module is configured to provide a data signal of the data signal terminal to the first terminal of the voltage stabilization module under the control of a signal of the write control signal terminal. The control terminal of the compensation module is connected to a compensation control signal terminal, and the input terminal of the compensation module is connected to the output terminal of the drive control module and the second input terminal of the light emission control module respectively. The compensation module is configured to store the threshold voltage of the drive control module in the voltage stabilization module under the control of the signal of the compensation control signal terminal. The control terminal of the light emission control module is connected to a light emission control signal terminal, the first input terminal of the light emission control module is connected to a third reference signal terminal, the second output terminal of the light emission control module is connected to the first terminal of the light emission component, and the second terminal of the light emission component is connected to a second reference signal terminal. The light emission control module is configured to control the drive of the drive control module for the light emission component under the control of the signal of the light emission control signal terminal.

In embodiments of the present disclosure, the drive control module comprises a drive transistor. A gate electrode of the drive transistor is the control terminal of the drive control module, a first electrode of the drive transistor is the input terminal of the drive control module and a second electrode of the drive transistor is the output terminal of the drive control module.

In embodiments of the present disclosure, the first reset module comprises a first switch transistor and a second switch transistor. A gate electrode of the first switch transistor is the control terminal of the first reset module, a first electrode of the first switch transistor is the first input terminal of the first reset module and a second electrode of the first switch transistor is the first output terminal of the first reset module. A first electrode of the second switch transistor is the second input terminal of the first reset module and a second electrode of the second switch transistor is the second output terminal of the first reset module. The gate electrode of the first switch transistor is connected to a gate electrode of the second switch transistor.

In embodiments of the present disclosure, the data write module comprises: a third switch transistor. A gate electrode of the third switch transistor is the control terminal of the data write module, a first electrode of the third switch transistor is the input terminal of the data write module and a second electrode of the third switch transistor is the output terminal of the data write module.

In embodiments of the present disclosure, the compensation module comprises: a fourth switch transistor. A gate electrode of the fourth switch transistor is the control terminal of the compensation module, a first electrode of the fourth switch transistor is the input terminal of the compensation module and a second electrode of the fourth switch transistor is the output terminal of the compensation module.

In embodiments of the present disclosure, the voltage stabilization module comprises: a capacitor. A first electrode of the capacitor is the first terminal of the voltage stabilization module and a second electrode of the capacitor is the second terminal of the voltage stabilization module.

In embodiments of the present disclosure, the light emission control module comprises a fifth switch transistor and a sixth switch transistor. A gate electrode of the fifth switch transistor is the control terminal of the light emission control module, a first electrode of the fifth switch transistor is the first input terminal of the light emission control module and a second electrode of the fifth switch transistor is the first output terminal of the light emission control module. A first electrode of the sixth switch transistor is the second input terminal of the light emission control module and a second electrode of the sixth switch transistor is the second output terminal of the light emission control module. The gate electrode of the fifth switch transistor is connected to a gate electrode of the sixth switch transistor.

In embodiments of the present disclosure, the pixel circuit further comprises: a second reset module. The second reset module is connected to the light emission component, and the second reset module is configured to reset the light emission component.

In embodiments of the present disclosure, the second reset module comprises a control terminal, an input terminal, and an output terminal. The control terminal and the input terminal of the second reset module are connected to the second reset control signal terminal, and the output terminal of the second reset module is connected to the first terminal of the light emission component. The second reset module is configured to reset the electric level of the first terminal of the light emission component under the control of a signal of the second reset control signal terminal.

In embodiments of the present disclosure, the second reset module comprises: a seventh switch transistor. A gate electrode of the seventh switch transistor is the control terminal of the second reset module, a first electrode of the seventh switch transistor is the input terminal of the second reset module and a second electrode of the seventh switch transistor is the output terminal of the second reset module.

In embodiments of the present disclosure, the drive transistor is a P-type transistor. The switch transistor is a P-type transistor or an N-type transistor.

In the embodiment of the present disclosure, the voltages of the first reference signal terminal and the third reference signal terminal are high level voltages, and the voltage of the second reference signal terminal is a low level voltage or ground.

According to a second aspect, the embodiments of the present disclosure provide a drive method of a pixel circuit for driving the pixel circuit, comprising: a reset stage: providing a valid control signal for the first reset module, resetting the voltage stabilization module by the first reset module, a write compensation stage: providing valid control signals for the data write module and the compensation module, providing a data signal to the voltage stabilization module by the data write module, storing the threshold voltage of the drive control module in the voltage stabilization module by the compensation module, a light emitting stage: providing a valid control signal for the light emission control module, controlling the drive of the drive control module for the light emission component by the light emission control module, driving the light emission component to emit light by the drive control module under the control of the voltage stored in the voltage stabilization module.

In embodiments of the present disclosure, the pixel circuit comprises a second reset module which is connected to the light emission component and is configured to reset the light emission component. The write compensation stage further comprises: resetting the light emission component by the second reset module.

According to a third aspect, the embodiments of the present disclosure provide an organic electroluminescent display panel comprising any one of the above-described pixel circuits.

According to a fourth aspect, the embodiments of the present disclosure provide a display device comprising any one of the above-described organic electroluminescent display panels.

For the pixel circuit, the drive method thereof and the related device provided in the embodiment of the present disclosure, the pixel circuit comprises a first reset module, a data write module, a compensation module, a voltage stabilization module, a drive control module, a light emission control module and a light emission component. The first reset module is used to reset the electric levels of the first and second terminals of the voltage stabilization module under the control of the signal of the first reset control signal terminal. The data write module is used to provide the signal of the data signal terminal to the first terminal of the voltage stabilization module under the control of the signal of the write control signal terminal. The compensation module is used for storing the threshold voltage of the drive control module in the voltage stabilization module under the control of the signal of the compensation control signal terminal. The light emission control module is used for controlling, together with the voltage stabilization module, the drive control module to drive the light emission component to emit light, under the control of the signal of the light emission control signal terminal. The pixel circuit can compensate for the drift of the threshold voltage of the drive control module by the cooperation of the above-described modules.

BRIEF DESCRIPTION OF THE DRAWINGS

In order to more clearly illustrate the technical solutions of the embodiments of the present disclosure, the drawings of the embodiments will be briefly described below. It should be understood that the drawings described below relate only to some embodiments of the present disclosure, rather than to limit the present disclosure, in which.

DETAILED DESCRIPTION

Hereinafter, specific embodiments of a pixel circuit, a drive method thereof, and a related device provided in embodiments of the present disclosure will be described below in detail with reference to the accompanying drawings. It is to be understood that the embodiments are intended to better explain the present disclosure rather than to limit the present disclosure.

Figure 1:
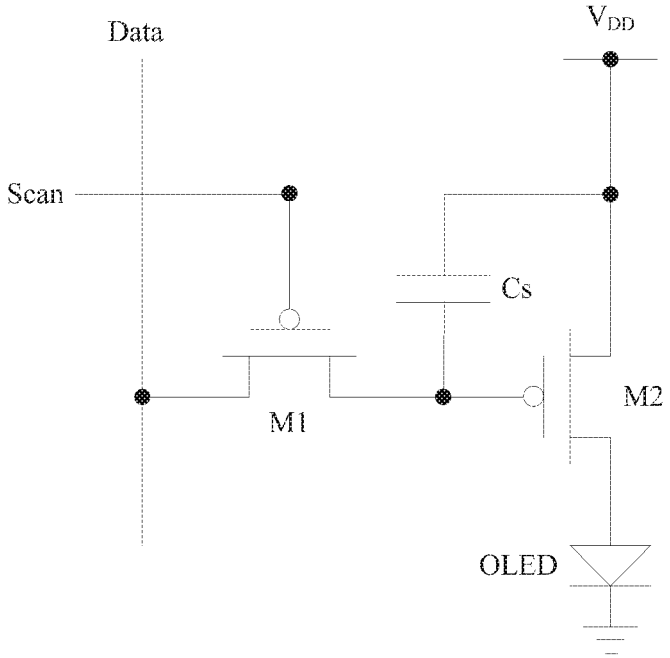
FIG. 1 is a schematic circuit diagram of a pixel circuit in the prior art.
Figure 2:
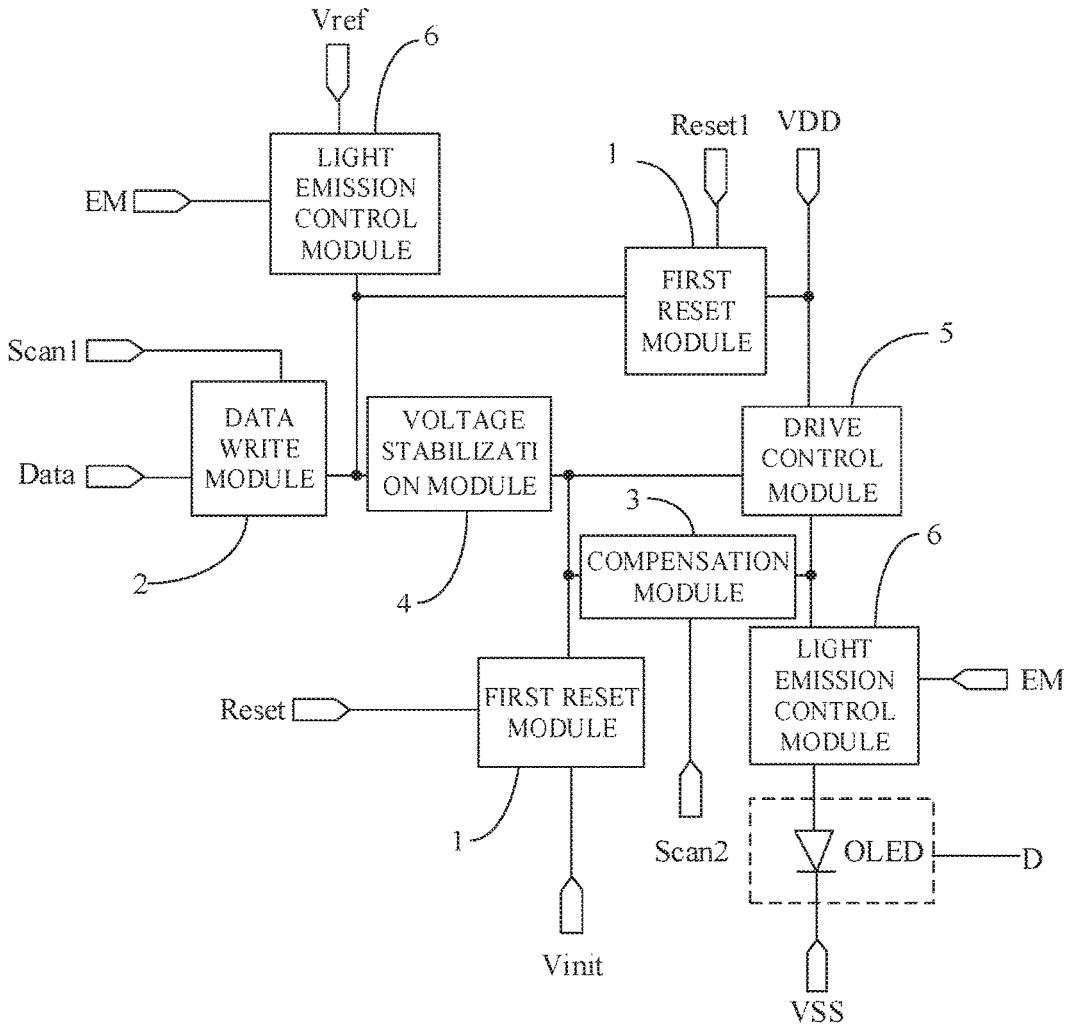
FIG. 2 is a schematic structural diagram of a pixel circuit according to a first embodiment of the present disclosure.

FIG. 2 is a schematic structural diagram of a pixel circuit according to a first embodiment of the present disclosure. As shown in FIG. 2, the pixel circuit of the first embodiment comprises a first reset module 1, a data write module 2, a compensation module 3, a voltage stabilization module 4, a drive control module 5, a light emission control module 6, and a light emission component D. The first reset module 1 is connected to the voltage stabilization module 4, and the first reset module 1 is configured to reset the voltage stabilization module 4. The data write module 2 is connected to the voltage stabilization module 4, and the data write module 2 is configured to provide a data signal to the voltage stabilization module 4. The compensation module 3 is connected to the voltage stabilization module 4 and the drive control module 5, and the compensation module 3 is configured to store the threshold voltage of the drive control module 5 in the voltage stabilization module 4. The voltage stabilization module 4 is connected to the drive control module 5, and the voltage stabilization module 4 is configured to store a voltage for controlling the drive control module 5. The drive control module 5 is connected to the light emission control module 6, and the drive control module 5 is configured to drive the light emission component D. The light emission control module 6 is connected to the drive control module 5 and the light emission component D, and the light emission control module 6 is configured to control the drive of the drive control module 5 for the light emission component D. The light emission component D is connected to the light emission control module 6, and the light emission component D is configured to emit light under the drive of the drive control module 5.

In embodiments of the present disclosure, the first reset module 1 comprises a control terminal, a first input terminal, a second input terminal, a first output terminal, and a second output terminal. The data write module 2 comprises a control terminal, an input terminal and an output terminal. The compensation module 3 comprises a control terminal, an input terminal and an output terminal. The voltage stabilization module 4 comprises a first terminal and a second terminal. The drive control module 5 comprises a control terminal, an input terminal and an output terminal. The light emission control module 6 comprises a control terminal, a first input terminal, a second input terminal, a first output terminal, and a second output terminal. The light emission component D comprises a first terminal and a second terminal. The control terminal of the first reset module 1 is connected to the first reset control signal terminal Reset1, the first input terminal of the first reset module 1 is connected to the input terminal of the drive control module 5 and the first reference signal terminal VDD respectively, the second input terminal of the first reset module 1 is connected to the initialization signal terminal Vinit, the first output terminal of the first reset module 1 is connected to the first terminal of the voltage stabilization module 4, the output terminal of the data write module 2 and the first output terminal of the light emission control module 6, respectively, and the second output terminal of the first reset module 1 is connected to the second terminal of the voltage stabilization module 4, the control terminal of the drive control module 5 and the output terminal of the compensation module 3, respectively. The first reset module 1 is configured to reset the electric levels of the first terminal and the second terminal of the voltage stabilization module 4 under the control of the signal of the first reset control signal terminal Reset1.

The control terminal of the data write module 2 is connected to the write control signal terminal Scan1, and the input terminal of the data write module 2 is connected to the data signal terminal Data. The data write module 2 is configured to provide the data signal of the data signal terminal Data to the first terminal of the voltage stabilization module 4 under the control of the signal of the write control signal terminal Scan1.

The control terminal of the compensation module 3 is connected to the compensation control signal terminal Scan2, and the input terminal of the compensation module 3 is connected to the output terminal of the drive control module 5 and the second input terminal of the light emission control module 6, respectively. The compensation module 3 is configured to store the threshold voltage of the drive control module 5 in the voltage stabilization module 4 under the control of the signal of the compensation control signal terminal Scan2.

The control terminal of the light emission control module 6 is connected to a light emission control signal terminal EM, the first input terminal of the light emission control module 6 is connected to the third reference signal terminal Vref, the second output terminal of the light emission control module 6 is connected to the first terminal of the light emission component D, and the second terminal of the light emission component D is connected to the second reference signal terminal VSS. The light emission control module 6 is configured to control the drive of the drive control module 5 for the light emission component D under the control of a signal of the light emission control signal terminal EM.

The pixel circuit provided by the embodiment of the present disclosure comprises a first reset module, a data write module, a compensation module, a voltage stabilization module, a drive control module, a light emission control module and a light emission component. The first reset module is used to reset the electric levels of the first and second terminals of the voltage stabilization module under the control of the signal of the first reset control signal terminal. The data write module is used to provide the signal of the data signal terminal to the first terminal of the voltage stabilization module under the control of the signal of the write control signal terminal. The compensation module is used for storing the threshold voltage of the drive control module in the voltage stabilization module under the control of the signal of the compensation control signal terminal. The light emission control module is used for controlling, together with the voltage stabilization module, the drive control module to drive the light emission component to emit light, under the control of the signal of the light emission control signal terminal. The pixel circuit can compensate for the drift of the threshold voltage of the drive control module by the cooperation of the above-described modules, whereby during light emission display, the drive current for driving the light emission component to emit light may be related to the voltage of the data signal, irrespective of the threshold voltage of the drive control module and the voltage of the first reference signal terminal, and can prevent the influence of the threshold voltage and the IR drop on the current flowing through the light emission component, thereby maintaining the operating current for driving the light emission component to emit light consistent, and improving the evenness of display luminance of the display region of the display device.

Figure 3:
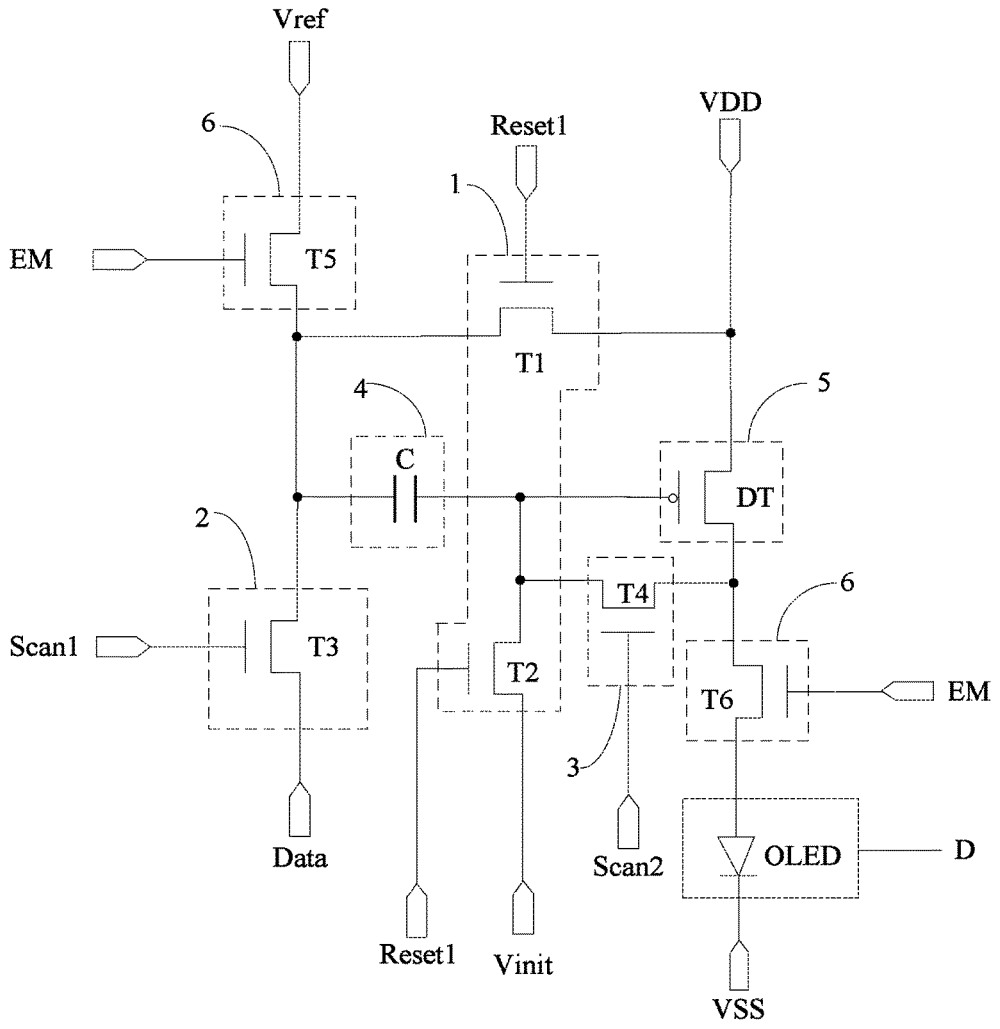
FIG. 3 is a schematic circuit diagram of the pixel circuit shown in FIG. 2.
Figure 4:
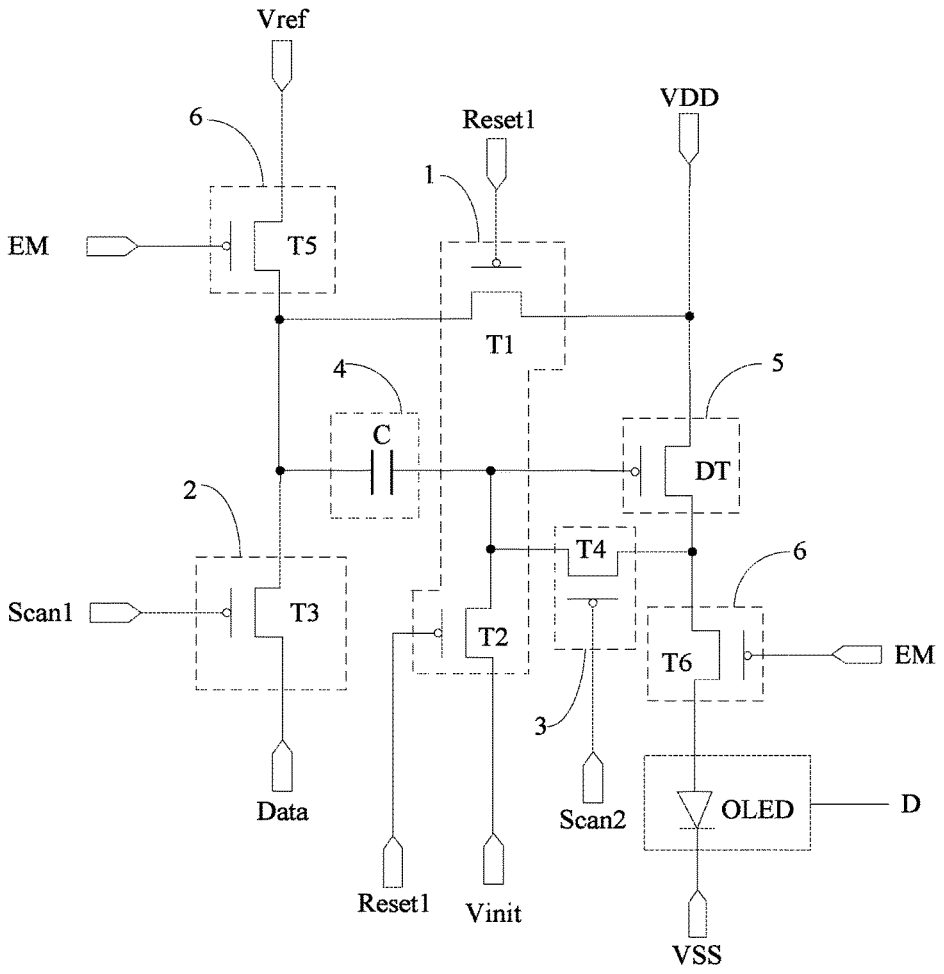
FIG. 4 is another schematic circuit diagram of the pixel circuit shown in FIG. 2.

FIG. 3 is a schematic circuit diagram of the pixel circuit shown in FIG. 2. FIG. 4 is another schematic circuit diagram of the pixel circuit shown in FIG. 2.

In embodiments of the present disclosure, the light emission component D in the pixel circuit may be an organic light emitting diode OLED. As shown in FIGS. 3 and 4, the anode of the organic light emitting diode is the first terminal of the light emission component and the cathode of the organic light emitting diode is the second terminal of the light emission component. The organic light emitting diode implements light emission and displaying under the action of the saturation current of the drive control module.

In embodiments of the present disclosure, as shown in FIGS. 3 and 4, the drive control module 5 may include a drive transistor DT. A gate electrode of the drive transistor DT is the control terminal of the drive control module 5, a first electrode of the drive transistor DT is the input terminal of the drive control module 5 and a second electrode of the drive transistor DT is the output terminal of the drive control module 5.

In embodiments of the present disclosure, the drive transistor DT may be a P-type transistor. Since the threshold voltage $V_{th}$ of the P-type transistor is a negative value, in order to ensure that the drive transistor DT can operate normally, the voltage of the corresponding first reference signal terminal VDD may be a high level voltage and the voltage of the second reference signal terminal VSS may be a ground voltage or a low level voltage.

Further, in embodiments of the present disclosure, the voltage of the third reference signal terminal Vref may be consistent with the voltage of the first reference signal terminal VDD and also be a high level voltage.

The specific structure of the drive control module in the pixel circuit is merely illustrated above by way of example, and in the present disclosure, the specific structure of the drive control module is not limited to the above-described structure, and may be other structures known to those skilled in the art, and will not be described herein.

In the embodiments of the present disclosure, as shown in FIGS. 3 and 4, the first reset module 1 may include a first switch transistor T1 and a second switch transistor T2. A gate electrode of the first switch transistor T1 is connected to the gate electrode of the second switch transistor T2 and is the control terminal of the first reset module 1, a first electrode of the first switch transistor T1 is the first input terminal of the first reset module 1, and a second electrode of the first switch transistor T1 is the first output terminal of the first reset module 1. A first electrode of the second switch transistor T2 is the second input terminal of the first reset module 1 and a second electrode of the second switch transistor T2 is the second output terminal of the first reset module 1.

Further, in embodiments of the present disclosure, as shown in FIG. 3, the first switch transistor T1 and the second switch transistor T2 may be N-type transistors. At the time, when the electric level of the first reset control signal terminal Reset1 is high, the first switch transistor T1 and the second switch transistor T2 are in an ON state, and when the electric level of the first reset control signal terminal Reset1 is low, the first switch transistor T1 and the second switch transistor T2 are in an OFF state. Or, as shown in FIG. 4, the first switch transistor T1 and the second switch transistor T2 may be P-type transistors. At the time, when the electric level of the first reset control signal terminal Reset1 is low, the first switch transistor T1 and the second switch transistors T2 are in an ON state, and when the electric level of the first reset control signal terminal Reset1 is high, the first switch transistor T1 and the second switch transistor T2 are in an OFF state. They will not be limited herein.

Specifically, as to the pixel circuit provided by the embodiments of the present disclosure, when the first switch transistor and the second switch transistor are in an ON state under the control of the signal of the first reset control signal terminal, the signal of the first reference signal terminal is transmitted to the first terminal of the voltage stabilization module through the first switch transistor turned on, and the signal of the initialization signal terminal is transmitted to the second terminal of the voltage stabilization module through the second switch transistor turned on, to reset the electric levels of the first terminal and the second terminal of the voltage stabilization module, respectively.

The specific structure of the first reset module in the pixel circuit is merely illustrated above by way of example, and in the embodiments of the present disclosure, the specific structure of the first reset module is not limited to the above-described structure provided in the embodiments of the present disclosure, and may be other structures known to those skilled in the art, and will not be limited herein.

In embodiments of the present disclosure, as shown in FIGS. 3 and 4, the data write module 2 may include a third switch transistor T3. A gate electrode of the third switch transistor T3 is the control terminal of the data write module 2, a first electrode of the third switch transistor T3 is the input terminal of the data write module 2 and a second electrode of the third switch transistor T3 is the output terminal of the data write module 2.

Further, in embodiments of the present disclosure, as shown in FIG. 3, the third switch transistor T3 may be an N-type transistor. At the time, when the electric level of the write control signal terminal Scan1 is high, the third switch transistor T3 is in an ON state, and when the electric level of the write control signal terminal Scan1 is low, the third switch transistor T3 is in an OFF state. Or, as shown in FIG. 4, the third switch transistor T3 may be a P-type transistor. At the time, when the electric level of the write control signal terminal Scan1 is low, the third switch transistor T3 is in the ON state, and when the electric level of the write control signal terminal Scan1 is high, the third switch transistor T3 is in the OFF state. This will not be limited herein.

Specifically, as to the pixel circuit provided in embodiments of the present disclosure, when the third switch transistor is in an ON state under the control of the signal of the write control signal terminal, the signal of the data signal terminal is transmitted to the first terminal of the voltage stabilization module through the third switch transistor turned on, to implement the data write function.

The specific structure of the data write module in the pixel circuit is merely illustrated above by way of example, and in embodiments of the present disclosure, the specific structure of the data write module is not limited to the above-described structure provided in the embodiment of the present disclosure, and may be other structures known to those skilled in the art, and will not be described herein.

In the embodiment of the present disclosure, as shown in FIGS. 3 and 4, the compensation module 3 may include a fourth switch transistor T4. A gate electrode of the fourth switch transistor T4 is the control terminal of the compensation module 3, a first electrode of the fourth switch transistor T4 is the input terminal of the compensation module 3, and a second electrode of the fourth switch transistor T4 is the output terminal of the compensation module 3.

Further, in embodiments of the present disclosure, as shown in FIG. 3, the fourth switch transistor T4 may be an N-type transistor, and at this time, when the electric level of the compensation control signal terminal Scan2 is high, the fourth switch transistor T4 is in the ON state, and when the electric level of the compensation control signal terminal Scan2 is low, the fourth switch transistor T4 is in the OFF state. Or, as shown in FIG. 4, the fourth switch transistor T4 may be a P-type transistor. At the time, when the electric level of the compensation control signal terminal Scan2 is low, the fourth switch transistor T4 is in the ON state, and when the electric level of the compensation control signal terminal Scan2 is high, the fourth switch transistor T4 is in the OFF state. This will not be limited herein.

Specifically, as to the pixel circuit provided by embodiments of the present disclosure, when the fourth switch transistor is in the ON state under the control of the signal of the compensation control signal terminal, the fourth switch transistor connects the drive transistor to form a diode structure, the signal of the first reference signal terminal is transmitted to the second terminal of the voltage stabilization module through the drive transistor of the diode structure, thereby storing the threshold voltage of the drive transistor in the voltage stabilization module.

In the embodiment of the present disclosure, the compensation control signal terminal Scan2 may be the same signal terminal as the write control signal terminal Scan1.

The specific structure of the compensation module in the pixel circuit is merely illustrated above by way of example, and in embodiments of the present disclosure, the specific structure of the compensation module is not limited to the above-described structure provided in the embodiments of the present disclosure, and may be other structures known to those skilled in the art, and will not be limited herein.

In an embodiment of the disclosure, as shown in FIGS. 3 and 4, the voltage stabilization module 4 may include a capacitor C. The first electrode of the capacitor C is the first terminal of the voltage stabilization module 4, and the second electrode of the capacitor C is the second terminal of the voltage stabilization module 4.

The specific structure of the voltage stabilization module in the pixel circuit is merely illustrated above by way of example, and in embodiments of the present disclosure, the specific structure of the voltage stabilization module is not limited to the above-described structure provided in the embodiments of the present disclosure, and may be other structures known to those skilled in the art, and will not be limited herein.

In embodiments of the present disclosure, as shown in FIGS. 3 and 4, the light emission control module 6 may include a fifth switch transistor T5 and a sixth switch transistor T6. A gate electrode of the fifth switch transistor T5 is connected to the gate electrode of the sixth switch transistor T6 and is the control terminal of the light emission control module 6, a first electrode of the fifth switch transistor T5 is the first input terminal of the light emission control module 6, a second electrode of the fifth switch transistor T5 is the first output terminal of the light emission control module 6. A first electrode of the sixth switch transistor T6 is the second input terminal of the light emission control module 6 and a second electrode of the sixth switch transistor T6 is the second output terminal of the light emission control module 6.

Further, in an embodiment of the present disclosure, as shown in FIG. 3, the fifth switch transistor T5 and the sixth switch transistor T6 may be N-type transistors. In this case, when the electric level of the control signal terminal Scan2 is high, the fifth switch transistor T5 and the sixth switch transistor T6 are in an ON state, and when the electric level of the compensation control signal terminal Scan2 is low, the fifth switch transistor T5 and the sixth switch transistor T6 are in an OFF state. Or, as shown in FIG. 4, the fifth switch transistor T5 and the sixth switch transistor T6 may be P-type transistors. In this case, when the electric level of the compensation control signal terminal Scan2 is low, the fifth switch transistor T5 and the sixth switch transistor T6 are in the ON state, and when the electric level of the compensation control signal terminal Scan2 is high, the fifth switch transistor T5 and the sixth switch transistor T6 are in the OFF state. This will not be limited herein.

Specifically, as to the pixel circuit provided in embodiments of the present disclosure, when the fifth switch transistor and the sixth switch transistor are in the ON state under the control of the signal of the light emission control signal terminal, the sixth switch transistor turned on conducts the output terminal of the drive control module with the light emission component, and at the same time the signal of the third reference signal terminal is transmitted to the first terminal of the voltage stabilization module through the fifth switch transistor which is turned on, and together with the voltage stabilization module, controls the drive control module to drive the light emission component to emit light.

The specific structure of the compensation module in the pixel circuit is merely illustrated above by way of example, and in embodiments of the present disclosure, the specific structure of the compensation module is not limited to the above-described structure provided in the embodiments of the present disclosure, and may be other structures known to those skilled in the art, and will not be limited herein.

In embodiments of the present disclosure, the voltage at the third reference signal terminal may be equal to the voltage at the first reference signal terminal, and is not limited herein.

Figure 5:
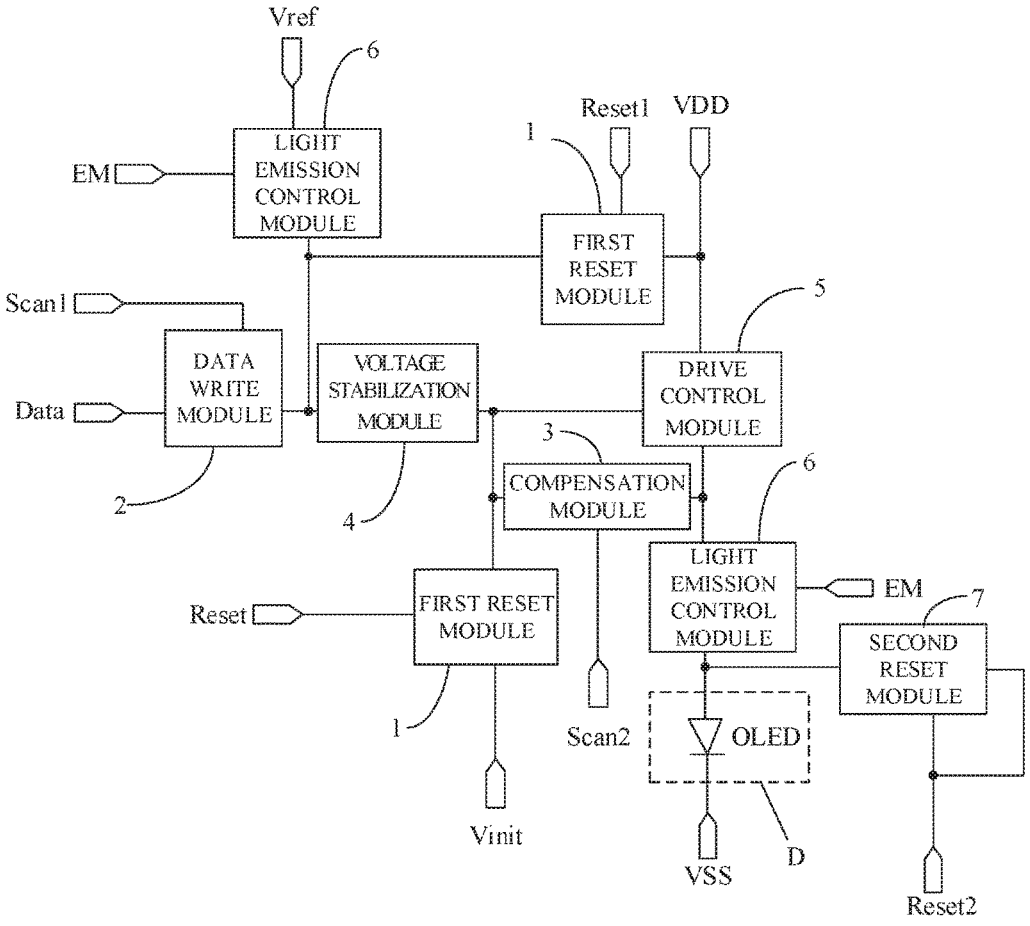
FIG. 5 is a schematic structural diagram of a pixel circuit according to a second embodiment of the present disclosure.

FIG. 5 is a schematic structural diagram of a pixel circuit according to a second embodiment of the present disclosure. As shown in FIG. 5, the pixel circuit of the second embodiment further comprises a second reset module 7. A control terminal and an input terminal of the second reset module 7 are connected to the second reset control signal terminal Reset2 and an output terminal of the second reset module 7 is connected to the first terminal of the light emission component D. The second reset module 7 is used for resetting the electric level of the first terminal of the light emission component D under the control of the second reset control signal terminal Reset2, to make the display at a low grayscale darker and improve the contrast.

Figure 6:
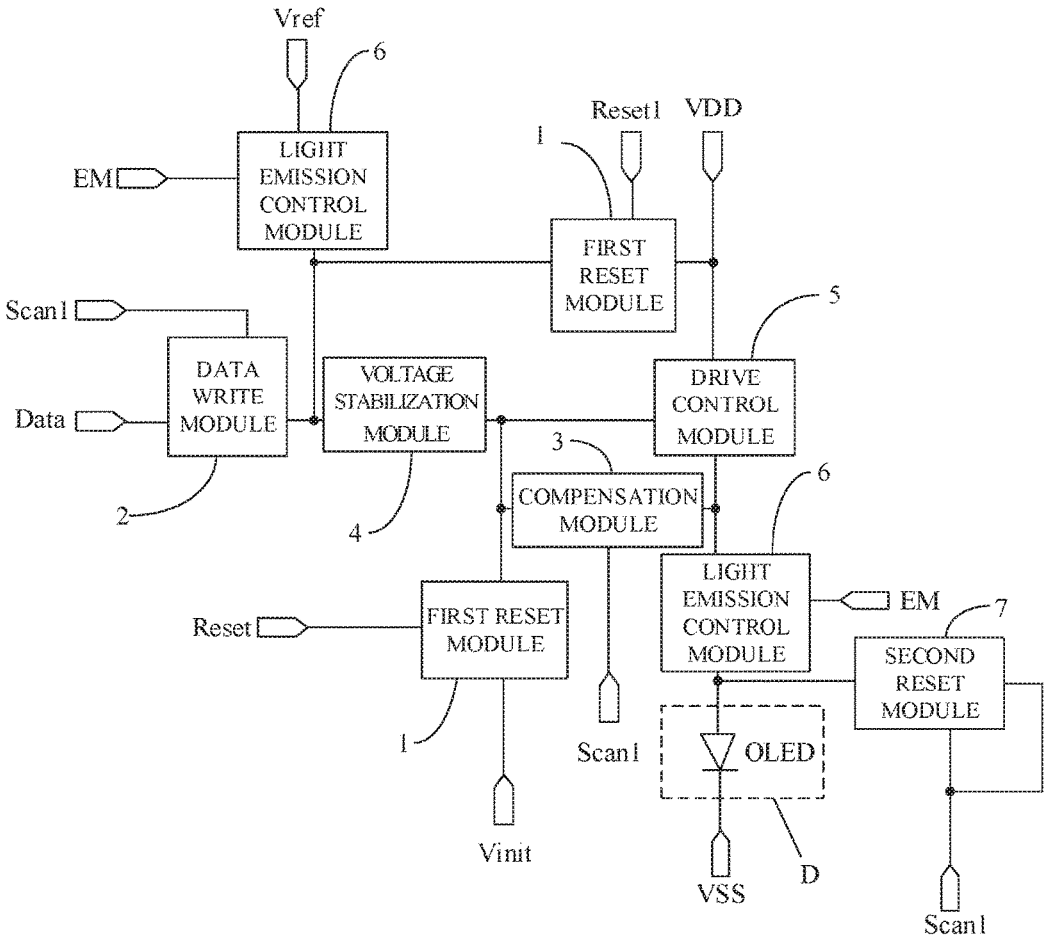
FIG. 6 is a schematic structural diagram of a pixel circuit according to a third embodiment of the present disclosure.

FIG. 6 is a schematic structural diagram of a pixel circuit according to a third embodiment of the present disclosure. In the third embodiment of the present disclosure, as shown in FIG. 6, the compensation control signal terminal Scan2, the write control signal terminal Scan1, and the second reset control signal terminal Reset2 may be the same signal terminal (wherein in FIG. 6, the control signal terminal Scan1 replaces the compensation control signal terminal Scan2 and the second reset control signal terminal Reset2).

Figure 7:
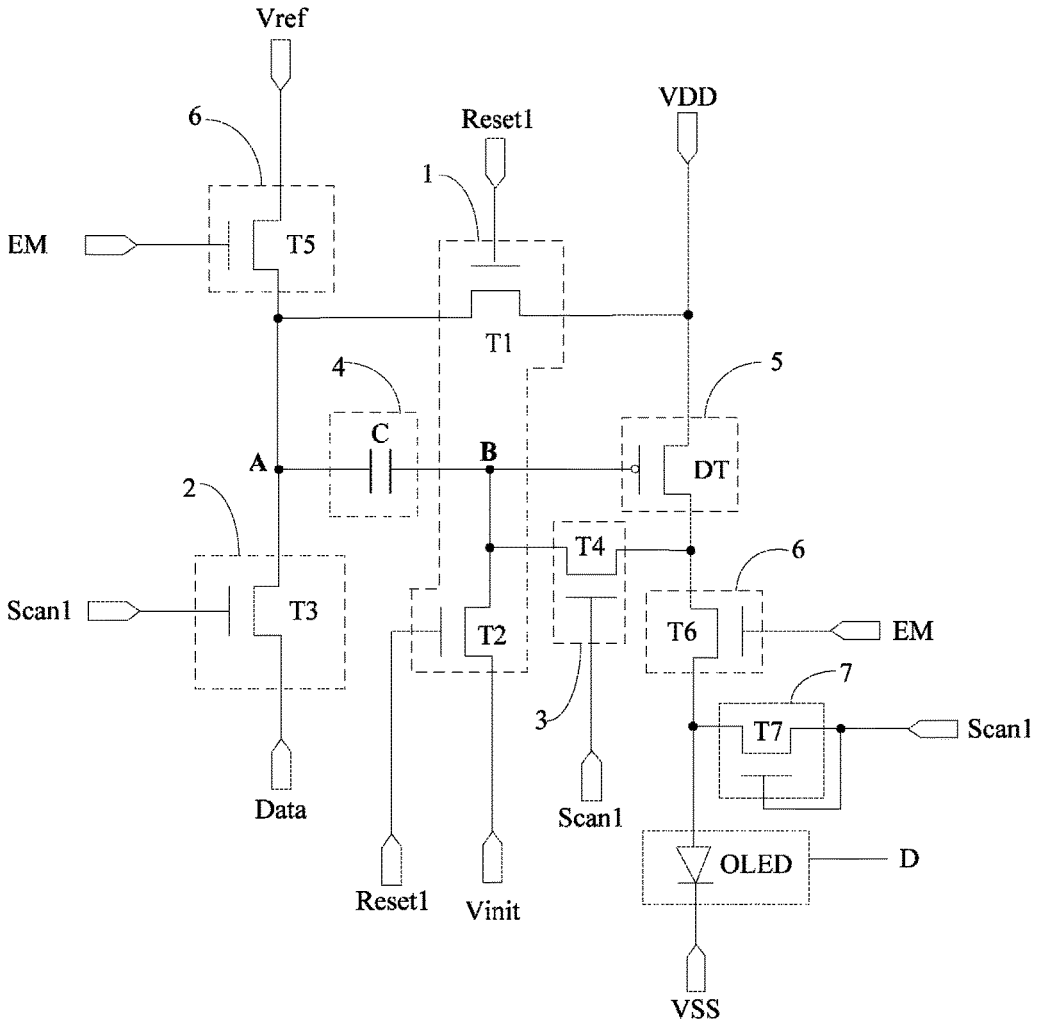
FIG. 7 is a schematic circuit diagram of the pixel circuit shown in FIG. 6.
Figure 8:
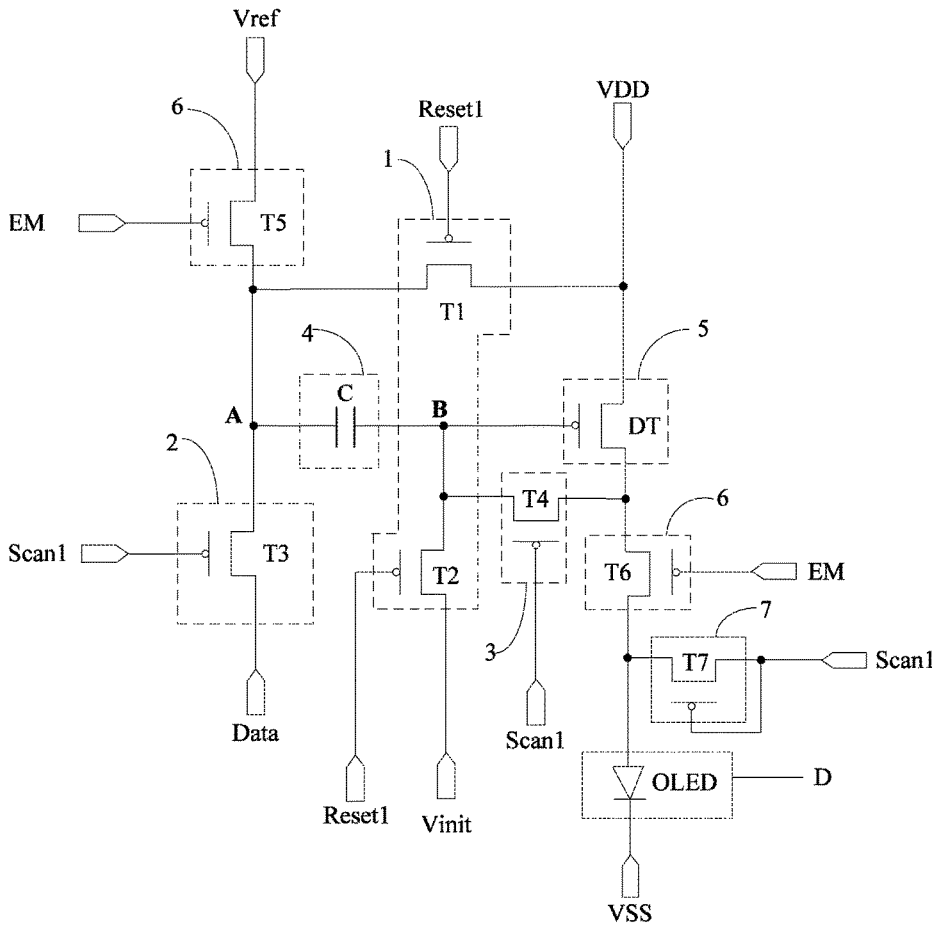
FIG. 8 is another schematic circuit diagram of the pixel circuit shown in FIG. 6.

FIG. 7 is a schematic circuit diagram of the pixel circuit shown in FIG. 6. FIG. 8 is another schematic circuit diagram of the pixel circuit shown in FIG. 6. As shown in FIGS. 7 and 8, the second reset module 7 may include a seventh switch transistor T7. A gate electrode of the seventh switch transistor T7 is the control terminal of the second reset module 7, a first electrode of the seventh switch transistor T7 is the input terminal of the second reset module 7 and a second electrode of the seventh switch transistor T7 is the output terminal of the second reset module 7.

Further, in embodiments of the present disclosure, as shown in FIG. 7, the seventh switch transistor T7 may be an N-type transistor. In this case, when the electric level of the second reset control signal terminal Reset2 is high, the seventh switch transistor T7 is in the ON state, and when the electric level of the second reset control signal terminal Reset2 is low, the seventh switch transistor T7 is in the OFF state. Or, as shown in FIG. 4, the seventh switch transistor T7 may be a P-type transistor. In this case, when the electric level of the second reset control signal terminal Reset2 is low, the seventh switch transistor T7 is in the ON state, and when the electric level of the reset control signal terminal Reset2 is high, the seventh switch transistor T7 is in the OFF state. This will not be limited herein.

Specifically, as to the pixel circuit provided in the embodiment of the present disclosure, when the seventh switch transistor is in the ON state under the control of the signal of the second reset control signal terminal, the signal of the second reset control signal terminal is transmitted to the first terminal of the light emission component through the seventh switch transistor, thereby resetting the electric level of the first terminal of the light emission component.

The specific structure of the second reset module in the pixel circuit is merely illustrated above by way of example, and in embodiments of the present disclosure, the specific structure of the second reset module is not limited to the above-described structure provided in the embodiments of the present disclosure, and may be other structures known to those skilled in the art. This will not be limited herein.

It is to be noted that the drive transistor and the switch transistor mentioned in the above embodiments of the present disclosure may be a thin film transistor (TFT), and may be a metal oxide semiconductor field effect transistor (MOS) and may not be limited. In the specific implementation, functions of the first and second electrodes of these transistors are interchangeable, depending on the type of the transistor and the input signal, and are not specifically distinguished here.

In general, when the transistor is a P-type transistor, the first electrode is the source electrode and the second electrode is the drain electrode. When the transistor is an N-type transistor, the first electrode is the drain electrode, and the second electrode is the source electrode. In order to simplify the manufacturing process, all the switch transistors may be P-type transistors at the same time or may be N-type transistors at the same time, and are not limited herein. The drive transistor and the switch transistor mentioned in the embodiments of the present disclosure may all be designed as a P-type transistor, so that the manufacturing process of the pixel circuit can be simplified.

The operation of the pixel circuit provided in the embodiment of the present disclosure will be described below with reference to the pixel circuits shown in FIGS. 7 and 8, respectively. For convenience of the description, the first terminal of the capacitor C is defined as the first node A, the second terminal of the capacitor C is defined as the second node B. Moreover, in the following description, a high-level signal is denoted by 1 and a low-level signal is denoted by 0.

First, the operation thereof is described taking the structure of the pixel circuit as shown in FIG. 7 as an example. In the pixel circuit as shown in FIG. 7, the drive transistor DT is a P-type transistor, all of the switch transistors are N-type transistors. Each N-type transistor is turned on at a high electric level and is turned off at a low electric level.

Figure 9:
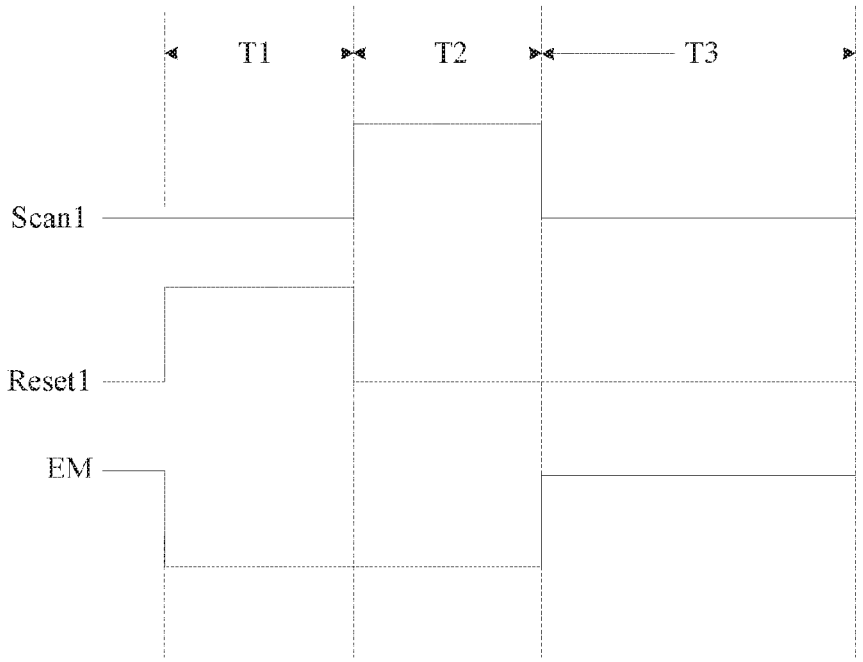
FIG. 9 is a circuit timing diagram of the pixel circuit shown in FIG. 7.

FIG. 9 is a circuit timing diagram of the pixel circuit shown in FIG. 7. In the following, the three stages T1, T2 and T3 in the input timing chart shown in FIG. 9 are selected for description.

In the T1 stage, Scan1=0, Reset1=1, EM=0.

The first switch transistor T1 and the second switch transistor T2 are in an ON state, the third switch transistor T3, the fourth switch transistor T4, the fifth switch transistor T5, the sixth switch transistor T6, and the seventh switch transistor T7 are in an off state. The signal of the first reference signal terminal VDD is transmitted to the first node A through the first switch transistor T1 turned on and the signal of the initialization signal terminal Vinit is transmitted to the second node B through the second switch transistor T2 which is turned on. In the stage, the voltage of the first node A is reset to the voltage of the first reference signal terminal VDD and the voltage of the second node B is reset to the voltage of the initialization signal terminal Vinit.

In the T2 stage, Scan1=1, Reset1=0, EM=0.

The third switch transistor T3, the fourth switch transistor T4 and the seventh switch transistor T7 are in an ON state, and the first switch transistor T1, the second switch transistor T2, the fifth switch transistor T5 and the sixth switch transistor T6 are in an off state. The fourth switch transistor T4 turned on causes the drive transistor DT to be connected as a diode structure, and the signal of the data signal terminal Data is transmitted to the first node A through the third switch transistor T3 turned on, so that the voltage of the first electrical node A is the voltage $V_{data}$ of the data signal terminal. The signal of the first reference signal terminal VDD is transmitted to the second node B through the drive transistor DT as the diode structure, so that the voltage of the second node B is $V_{DD}+V_{th}$, wherein $V_{DD}$ is the voltage of the first reference signal terminal VDD, and $V_{th}$ is the threshold voltage of the drive transistor DT. At the same time, the signal of the write control signal terminal Scan1 is transmitted to the first terminal of the light emission component D through the seventh switch transistor T7 turned on.

In the T3 stage, Scan1=0, Reset1=0, EM=1.

The fifth switch transistor T5 and the sixth switch transistor T6 are in an ON state, and the first switch transistor T1, the second switch transistor T2, the third switch transistor T3, the fourth switch transistor T4, and the seventh switch transistor T7 are in an off state. The signal of the third reference signal terminal Vref is transmitted to the first node A through the first switch transistor turned on, and the electric level of the first node A is changed from $V_{data}$ in the previous stage to $V_{ref}$ where $V_{ref}$ is the voltage of the third reference signal terminal Vref. Due to the action of the capacitor C, according to the principle of conservation of electric charge of the capacitance, the voltage of the second node B is changed from $V_{DD}+V_{th}$ in the previous stage to $V_{DD}+V_{th}+V_{ref}-V_{data}$. Therefore, at this stage, the voltage of the gate electrode of the drive transistor DT is maintained at $V_{DD}+V_{th}+V_{ref}-V_{data}$, the voltage of the source electrode of the drive transistor DT is the voltage $V_{DD}$ of the first reference signal terminal VDD, and the drive transistor DT works in a saturated state. According to the current property in the saturated state, it can be seen that the operating current $I_{OLED}$ flowing through the drive transistor DT and driving the OLED to emit light satisfies the formula: $I_{OLED}=K(V_{gs}-V_{th})^2=K(V_{DD}+V_{th}+V_{ref}-V_{data}-V_{DD}-V_{th})^2-K(V_{ref}-V_{data})^2$, where K is a structural parameter, is relatively stable when the transistor structure does not change, and can be considered as a constant. It can be seen that the operating current $I_{OLED}$ of the organic light emitting diode OLED has not been affected by the threshold voltage $V_{th}$ of the drive transistor DT and is independent of the voltage $V_{DD}$ of the first reference signal terminal VDD, only associated with the voltage $V_{data}$ of the data signal terminal Data and the voltage $V_{ref}$ of the third reference signal terminal Vref, completely resolving the influence of the drift of the threshold voltage $V_{th}$ of the drive transistor DT due to the manufacturing process and the long time operation and of IR Drop on the operating current $I_{OLED}$ of the organic light emitting diode OLED, thereby improving the evenness of the panel display.

Figure 10:
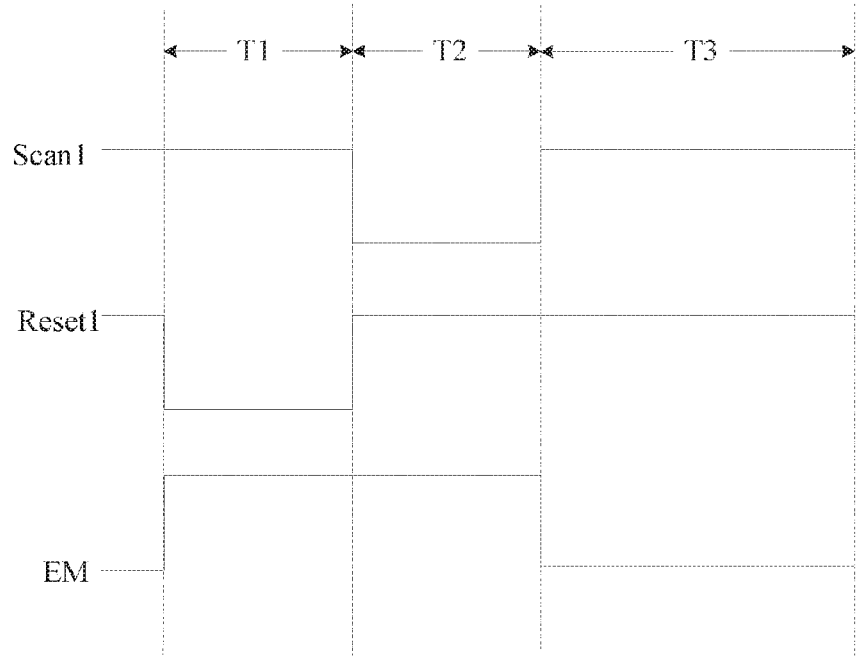
FIG. 10 is a circuit timing diagram of the pixel circuit shown in FIG. 8.

Then, the operation of the pixel circuit is described by taking the structure of the pixel circuit shown in FIG. 8 as an example, wherein in the pixel circuit as shown in FIG. 8, the drive transistor DT and all the switch transistors are P-type transistors, and each P-type transistor is turned on at a low level and is turned off at a high level. FIG. 10 is a circuit timing diagram of the pixel circuit shown in FIG. 8. In the following, the three stages T1, T2 and T3 in the input timing chart shown in FIG. 10 are selected for description.

In the T1 stage, Scan1=1, Reset1=0, EM=1.

The first switch transistor T1 and the second switch transistor T2 are in an ON state, the third switch transistor T3, the fourth switch transistor T4, the fifth switch transistor T5, the sixth switch transistor T6, and the seventh switch transistor T7 are in an off state. The signal of the first reference signal terminal VDD is transmitted to the first node A through the first switch transistor T1 turned on and the signal of the initialization signal terminal Vinit is transmitted to the second node B through the second switch transistor T2 turned on. In this stage, the voltage of the first node A is reset to the voltage of the first reference signal terminal VDD and the voltage of the second node B is reset to the voltage of the initialization signal terminal Vinit.

In the T2 stage, Scan1=0, Reset1=1, EM=1.

The third switch transistor T3, the fourth switch transistor T4 and the seventh switch transistor T7 are in an ON state, and the first switch transistor T1, the second switch transistor T2, the fifth switch transistor T5 and the sixth switch transistor T6 are in an off state. The fourth switch transistor T4 turned on causes the drive transistor DT to be connected as a diode structure, and the signal of the data signal terminal Data is transmitted to the first node A through the third switch transistor T3 turned on so that the voltage of the first electrical node A is the voltage $V_{data}$ of the data signal terminal Data. The signal of the first reference signal terminal VDD is transmitted to the second node B through the drive transistor DT of the diode structure so that the voltage of the second node B is $V_{DD}+V_{th}$, where $V_{DD}$ is the voltage of the first reference signal terminal VDD, and $V_{th}$ is the threshold voltage of the drive transistor DT. At the same time, the signal of the write control signal terminal Scan1 is transmitted to the first terminal of the light emission component D through the seventh switch transistor T7 turned on.

In the T3 stage, Scan1=1, Reset1=1, EM=0.

The fifth switch transistor T5 and the sixth switch transistor T6 are in an ON state, and the first switch transistor T1, the second switch transistor T2, the third switch transistor T3, the fourth switch transistor T4, and the seventh switch transistor T7 are in an off state. The signal of the third reference signal terminal Vref is transmitted to the first node A through the first switch transistor turned on, and the electric level of the first node A is changed from $V_{data}$ in the previous stage to $V_{ref}$ where $V_{ref}$ is the voltage of the third reference signal terminal Vref. Due to the action of the capacitor C, according to the principle of conservation of electric charge of the capacitance, the voltage of the second node B is changed from $V_{DD}+V_{th}$ in the previous stage to $V_{DD}+V_{th}+V_{ref}-V_{data}$. Therefore, at this stage, the voltage of the gate electrode of the drive transistor DT is maintained at $V_{DD}+V_{th}+V_{ref}-V_{data}$, the voltage of the source electrode of the drive transistor DT is the voltage $V_{DD}$ of the first reference signal terminal VDD, and the drive transistor DT works in a saturated state. According to the current property in the saturated state, it can be seen that the operating current $I_{OLED}$ flowing through the drive transistor DT and driving the OLED to emit light satisfies the formula: $I_{OLED}=K(V_{gs}-V_{th})^2-K(V_{DD}+V_{th}+V_{ref}-V_{data}-V_{DD}-V_{th})^2-K(V_{ref}-V_{data})^2$, where K is a structural parameter, is relatively stable in the same structure, and can be considered as a constant. It can be seen that the operating current $I_{OLED}$ of the organic light emitting diode OLED has not been affected by the threshold voltage $V_{th}$ of the drive transistor DT and is independent of the voltage $V_{DD}$ of the first reference signal terminal VDD, only associated with the voltage $V_{data}$ of the data signal terminal Data and the voltage $V_{ref}$ of the third reference signal terminal Vref, completely resolving the influence of the drift of the threshold voltage $V_{th}$ of the drive transistor DT due to the manufacturing process and the long time operation and of IR Drop on the operating current $I_{OLED}$ of the organic light emitting diode OLED, thereby improving the evenness of the panel display.

The fourth embodiment of the present disclosure further provides a drive method of a pixel circuit for driving any one of the above-mentioned pixel circuits, comprising: a reset stage: providing a valid control signal for the first reset module, resetting the voltage stabilization module by the first reset module, a write compensation stage: providing a valid control signal for the data write module and the compensation module, providing a data signal to the voltage stabilization module by the data write module, storing the threshold voltage of the drive control module in the voltage stabilization module by the compensation module, a light emitting stage: providing a valid control signal for the light emission control module, controlling the drive of the drive control module for the light emission component by the light emission control module, driving the light emission component to emit light by the drive control module under the control of the voltage stored in the voltage stabilization module.

Figure 11:
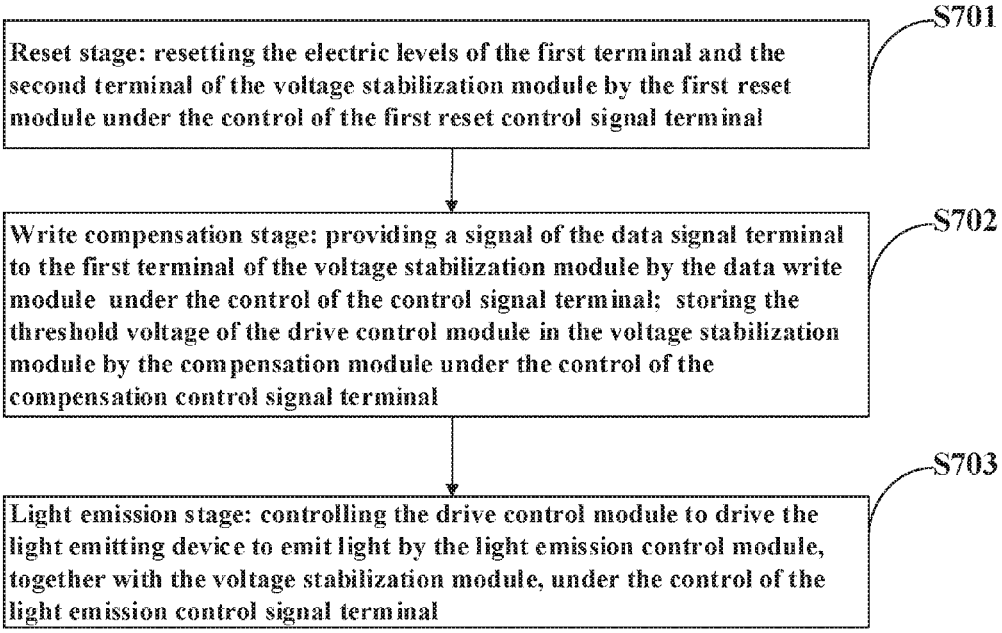
FIG. 11 is a schematic flow chart of a drive method of a pixel circuit according to a fourth embodiment of the present disclosure.

FIG. 11 is a schematic flow chart of a drive method of a pixel circuit according to a fourth embodiment of the present disclosure. As shown in FIG. 11, in the reset stage S701, the first reset module resets the electric levels at the first terminal and the second terminal of the voltage stabilization module under the control of the signal of the first reset control signal terminal. In the write compensation stage S702, the data write module is used to provide a signal of the data signal terminal to the first terminal of the voltage stabilization module under the control of a signal of the write control signal terminal. The compensation module stores the threshold voltage of the drive control module in the voltage stabilization module under the control of the signal of the compensation control signal terminal. In the light emission stage S703, the light emission control module controls, together with the voltage stabilization module, the drive control module to drive the light emission component to emit light under the control of the signal of the light emission control signal terminal.

In embodiments of the present disclosure, when the second reset module is included in the pixel circuit, the write compensation stage further comprises: resetting the electric level of the first terminal of the light emission component by the second reset module under the control of the signal of the second reset control signal terminal.

According to a fifth embodiment of the present disclosure, there is also provided an organic electroluminescence display panel comprising any of the above-described pixel circuits. Since the principle of resolving the problem of the organic electroluminescence display panel is similar to that of the pixel circuit described above, the implementation of the pixel circuit in the organic electroluminescence display panel may refer to the implementation of the pixel circuit in the foregoing examples, and will not be repeated.

According to a sixth embodiment of the present disclosure, there is also provided a display device including the above-described organic electroluminescence display panel. The display device may be a display, a mobile phone, a television, a notebook, an all-in-one computer, etc. those of ordinary skill in the art may appreciate that there are other essential components for the display device, which are not described herein and should not be construed to limit the present disclosure.

The pixel circuit, the drive method thereof and the related device provided by the embodiments of the disclosure comprise a first reset module, a data write module, a compensation module, a voltage stabilization module, a drive control module, a light emission control module and a light emission component. The first reset module is used to reset the electric levels of the first and second terminals of the voltage stabilization module under the control of the signal of the first reset control signal terminal. The data write module is used to provide the signal of the data signal terminal to the first terminal of the voltage stabilization module under the control of the signal of the write control signal terminal. The compensation module is used for storing the threshold voltage of the drive control module in the voltage stabilization module under the control of the signal of the compensation control signal terminal. The light emission control module is used for controlling, together with the voltage stabilization module, the drive control module to drive the light emission component to emit light, under the control of the signal of the light emission control signal terminal. The pixel circuit can compensate for the drift of the threshold voltage of the drive control module by the cooperation of the above-described modules, whereby during light emission display, the drive current for driving the light emission component to emit light may be related to the voltage of the data signal, irrespective of the threshold voltage of the drive control module and the voltage of the first reference signal terminal, and can prevent the influence of the threshold voltage and the IR drop on the current flowing through the light emission component, thereby maintaining consistent the operating current for driving the light emission component to emit light, and improving the evenness of display luminance of the display region of the display device.

It will be apparent that those skilled in the art may make various alterations and modifications to the present disclosure without departing from the spirit and scope of the disclosure. Thus, if these modifications and alterations of the present disclosure fall within the scope of the appended claims and their equivalents, the present is intended to include these modifications and alterations.

The invention claimed is:

1. A pixel circuit comprising: a first reset module, a second reset module, a data write module, a compensation module, a voltage stabilization module, a drive control module, a light emission control module and a light emission component, the first reset module including a control terminal, a first input terminal, a second input terminal, a first output terminal and a second output terminal, the data write module including a control terminal, an input terminal and an output terminal, the compensation module including a control terminal, an input terminal and an output terminal, the voltage stabilization module including a first terminal and a second terminal, the drive control module including a control terminal, an input terminal and an output terminal, the light emission control module including a control terminal, a first input terminal, a second input terminal, a first output terminal and a second output terminal, the light emission component including a first terminal and a second terminal, wherein the first reset module is connected to the voltage stabilization module, and is configured to reset the voltage stabilization module, wherein the data write module is connected to the voltage stabilization module, and is configured to provide a data signal to the voltage stabilization module, wherein the compensation module is connected to the voltage stabilization module and the drive control module, and is configured to store a threshold voltage of the drive control module in the voltage stabilization module, wherein the voltage stabilization module is connected to the drive control module, and is configured to store a voltage for controlling the drive control module, wherein the drive control module is connected to the light emission control module, and is configured to drive the light emission component, wherein the light emission control module is connected to the drive control module and the light emission component, and is configured to control the drive of the drive control module for the light emission component, wherein the light emission component is connected to the light emission control module, and is configured to emit light under the drive of the drive control module, wherein the control terminal of the first reset module is connected to a first reset control signal terminal, the first input terminal of the first reset module is connected to the input terminal of the drive control module and a first reference signal terminal respectively, the second input terminal of the first reset module is connected to an initialization signal terminal, the first output terminal of the first reset module is connected to the first terminal of the voltage stabilization module, the output terminal of the data write module and the first output terminal of the light emission control module, the second output terminal of the first reset module is connected to the second terminal of the voltage stabilization module, the control terminal of the drive control module and the output terminal of the compensation module, and the first reset module is configured to reset electric levels of the first terminal and the second terminal of the voltage stabilization module under the control of a signal of the first reset control signal terminal, wherein the control terminal of the data write module is connected to a write control signal terminal, the input terminal of the data write module is connected to a data signal terminal, and the data write module is configured to provide a data signal of the data signal terminal to the first terminal of the voltage stabilization module under the control of a signal of the write control signal terminal, wherein the control terminal of the compensation module is connected to a compensation control signal terminal, the input terminal of the compensation module is connected to the output terminal of the drive control module and the second input terminal of the light emission control module, and the compensation module is configured to store the threshold voltage of the drive control module in the voltage stabilization module under the control of the signal of the compensation control signal terminal, wherein the control terminal of the light emission control module is connected to a light emission control signal terminal, the first input terminal of the light emission control module is connected to a third reference signal terminal, the second output terminal of the light emission control module is connected to the first terminal of the light emission component, the second terminal of the light emission component is connected to a second reference signal terminal, and the light emission control module is configured to control the drive of the drive control module for the light emission component under the control of the signal of the light emission control signal terminal, wherein the first reset module includes a first switch transistor and a second switch transistor, a gate electrode of the first switch transistor is the control terminal of the first reset module, a first electrode of the first switch transistor is the first input terminal of the first reset module, a second electrode of the first switch transistor is the first output terminal of the first reset module, a first electrode of the second switch transistor is the second input terminal of the first reset module, a second electrode of the second switch transistor is the second output terminal of the first reset module, and the gate electrode of the first switch transistor is connected to a gate electrode of the second switch transistor, wherein the light emission control module comprises a fifth switch transistor and a sixth switch transistor, a gate electrode of the fifth switch transistor is the control terminal of the light emission control module, a first electrode of the fifth switch transistor is the first input terminal of the light emission control module, a second electrode of the fifth switch transistor is the first output terminal of the light emission control module, a first electrode of the sixth switch transistor is the second input terminal of the light emission control module, a second electrode of the sixth switch transistor is the second output terminal of the light emission control module, and the gate electrode of the fifth switch transistor is connected to a gate electrode of the sixth switch transistor, and wherein the second reset module comprises a seventh switch transistor, a gate electrode of the seventh switch transistor is the control terminal of the second reset module, a first electrode of the seventh switch transistor is the input terminal of the second reset module and a second electrode of the seventh switch transistor is the output terminal of the second reset module.

2. The pixel circuit according to claim 1, wherein the drive control module comprises a drive transistor, and wherein a gate electrode of the drive transistor is the control terminal of the drive control module, a first electrode of the drive transistor is the input terminal of the drive control module and a second electrode of the drive transistor is the output terminal of the drive control module.

3. The pixel circuit according to claim 2, wherein the drive transistor is a P-type transistor.

4. The pixel circuit according to claim 1, wherein the data write module comprises a third switch transistor, and wherein a gate electrode of the third switch transistor is the control terminal of the data write module, a first electrode of the third switch transistor is the input terminal of the data write module and a second electrode of the third switch transistor is the output terminal of the data write module.

5. The pixel circuit according to claim 4, wherein the first switch transistor or the second switch transistor is a P-type transistor or an N-type transistor.

6. The pixel circuit according to claim 1, wherein the compensation module comprises a fourth switch transistor, and wherein a gate electrode of the fourth switch transistor is the control terminal of the compensation module, a first electrode of the fourth switch transistor is the input terminal of the compensation module and a second electrode of the fourth switch transistor is the output terminal of the compensation module.

7. The pixel circuit according to claim 1, wherein the voltage stabilization module comprises a capacitor, and wherein a first electrode of the capacitor is the first terminal of the voltage stabilization module and a second electrode of the capacitor is the second terminal of the voltage stabilization module.

8. The pixel circuit according to claim 1, further comprising a second reset module, connected to the light emission component, the second reset module configured to reset the light emission component.

9. The pixel circuit according to claim 1, further comprising a second reset module including a control terminal, an input terminal, and an output terminal, wherein the control terminal and the input terminal of the second reset module are connected to a second reset control signal terminal, and the output terminal of the second reset module is connected to the first terminal of the light emission component, and wherein the second reset module is configured to reset an electric level of the first terminal of the light emission component under the control of a signal of the second reset control signal terminal.

10. The pixel circuit according to claim 9, wherein the first switch transistor or the second switch transistor is a P-type transistor or an N-type transistor.

11. The pixel circuit according to claim 1, wherein the first switch transistor or the second switch transistor is a P-type transistor or an N-type transistor.

12. The pixel circuit according to claim 1, wherein the voltages of the first reference signal terminal and the third reference signal terminal are high level voltages, and the voltage of the second reference signal terminal is a low level voltage or ground.

13. A drive method of a pixel circuit for driving the pixel circuit according to claim 1, comprising:

providing a valid control signal for the first reset module, and resetting the voltage stabilization module by the first reset module, providing valid control signals for the data write module and the compensation module, providing a data signal to the voltage stabilization module by the data write module, and storing the threshold voltage of the drive control module in the voltage stabilization module by the compensation module, and providing a valid control signal for the light emission control module, controlling the drive of the drive control module for the light emission component by the light emission control module, and driving the light emission component to emit light by the drive control module under the control of the voltage stored in the voltage stabilization module.

14. The drive method according to claim 13, wherein the second reset module is connected to the light emission component and is configured to reset the light emission component, and wherein the drive method further comprises providing a valid control signal for the second reset module and resetting the light emission component by the second reset module.

15. An organic electroluminescent display panel comprising the pixel circuit according to claim 1.

16. A display device comprising the organic electroluminescent display panel according to claim 15.

* * * * *